United States Patent [19]

Harvell

[11] 4,097,705

[45] Jun. 27, 1978

[54] QUICK LOCK-RELEASE MECHANISM FOR A TRIGGER SWITCH

[75] Inventor: Don L. Harvell, Greenville, S.C.

[73] Assignee: The Singer Company, New York, N.Y.

[21] Appl. No.: 822,162

[22] Filed: Aug. 5, 1977

[51] Int. Cl.[2] ..... H01H 9/06

[52] U.S. Cl. ..... 200/157; 200/44; 200/164 R; 200/321; 200/328; 310/50

[58] Field of Search ..... 200/157, 16 R, 16 A, 200/16 B, 16 C, 16 D, 42 R, 42 T, 44, 50 R, 80 R, 164 R, 321, 328; 318/345 R; 310/50, 68 R, 246

[56] References Cited

U.S. PATENT DOCUMENTS

| | | | |
|---|---|---|---|
| 2,481,499 | 9/1949 | Collura | 310/246 |
| 2,525,839 | 10/1950 | Sparklin | 310/50 |
| 3,328,613 | 6/1967 | Gawron | 200/157 |
| 3,549,844 | 12/1970 | Chambers | 200/157 |
| 3,588,411 | 6/1971 | Milkey | 200/157 |
| 3,594,523 | 7/1971 | Frenzel | 200/164 A |
| 3,626,118 | 12/1971 | Rotefuhr | 200/157 |
| 3,648,142 | 3/1972 | Corey | 310/50 |
| 3,660,742 | 5/1972 | Gawron | 318/345 R |
| 3,703,646 | 11/1972 | Jacyno | 200/157 |
| 3,869,591 | 3/1975 | Piber | 200/157 |

*Primary Examiner*—Ro E. Hart

*Attorney, Agent, or Firm*—H. Weinstein; E. L. Bell; R. E. Smith

[57] ABSTRACT

A quick lock-release mechanism for a trigger of a trigger switch mounted in the handle of a drill housing for activating a motor of a drill, which mechanism will selectively lock and release the trigger. The trigger is slidably connected in the handle with a tapered member affixed in the handle. A locking member is slidably connected to the tapered member and is in superposition to the trigger. A spring is disposed between the trigger and the locking member normally to urge each in opposite directions. The locking member is moveable outwardly of the handle to be forced by the tapered member into a wedge lock position against the trigger whereby the trigger switch is locked "on" and releasable upon slight trigger depression.

5 Claims, 7 Drawing Figures

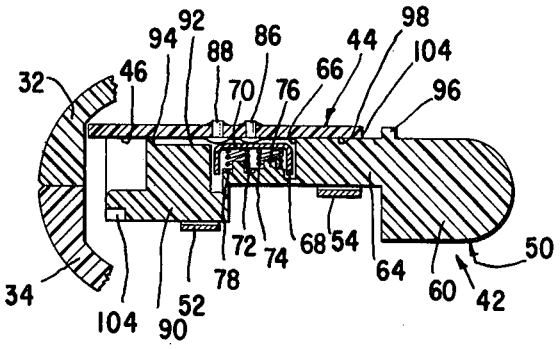
Fig. 5
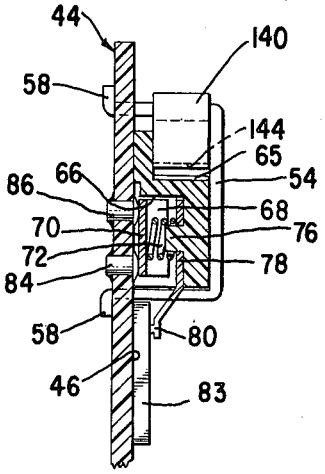
Fig. 6
Fig. 7
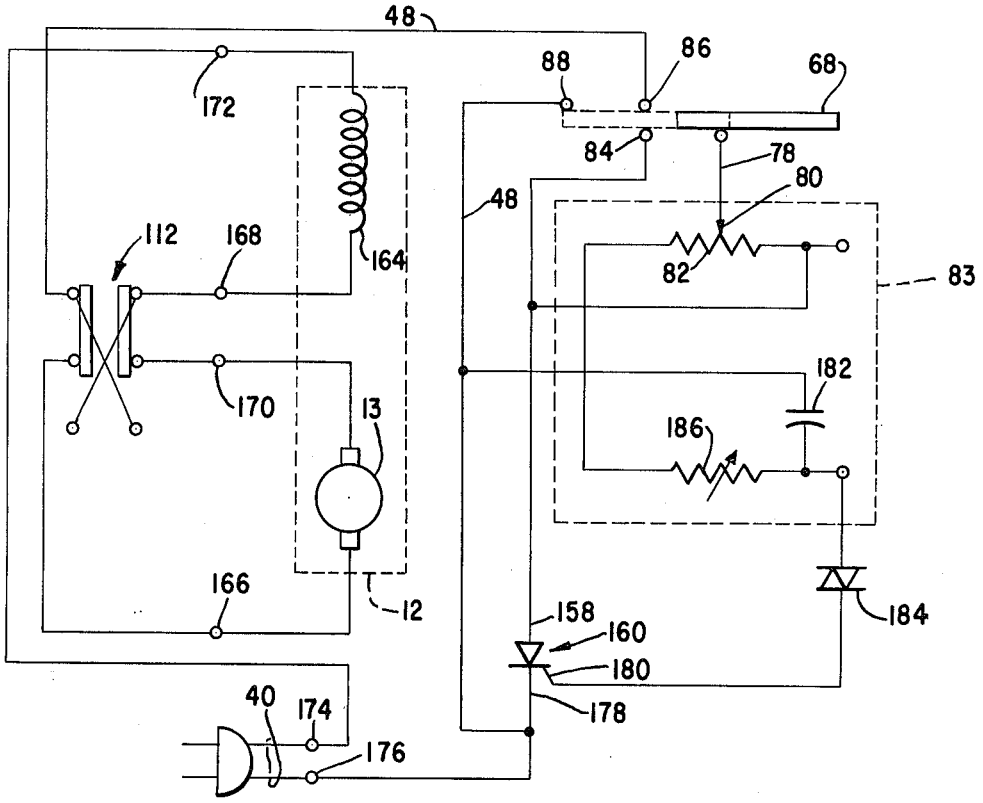

QUICK LOCK-RELEASE MECHANISM FOR A TRIGGER SWITCH

CROSS-REFERENCE TO OTHER APPLICATIONS

The present application is related to a copending application of the common assignee, U.S. Ser. No. 822,166 filed even date herewith, which application includes an alternate design of a similar type improved trigger switch.

BACKGROUND OF THE INVENTION

Trigger switches for power tools, such as drills, are either of the on-off or the speed control type with the speed being variably responsive to the amount of trigger depression. Whether the trigger switch is assembled in a plastic case or the housing of the power tool it will usually include a side lock button which coacts to lock the trigger in the desired position. The side lock button is inconvenient to operate, is susceptible to inconvenient use, accidental misuse or breakage, and has a limited range of speed setting for speed control switches.

SUMMARY OF THE INVENTION

It is therefore an object of the present invention to provide an improved quick lock-release mechanism for a trigger switch which overcomes the prior art disadvantages; which is simple, economical, and reliable; which is quick and easy to lock or release; which is selectivly lockable over a wide range of variable speed control settings; which mechanism includes a spring common to the trigger switch and lock-release mechanism; which spring is nested in a cavity formed in the trigger; which mechanism includes interacting high friction surfaces formed on the locking member and the trigger; and while mechanism includes a high friction surface on the trigger which is of greater length than the high friction surface on the locking member.

Other objects and advantages will be apparent from the following description of the invention and the novel features will be particularly pointed out hereinafter in the claims.

BRIEF DESCRIPTION OF THE DRAWINGS

This invention is illustrated in accompanying drawings in which:

FIG. 5 is a top plan view taken along lines 5—5 of FIG. 2.

FIG. 6 is an elevational view taken along lines 6—6 of FIG. 2.

FIG. 7 is a schematic circuit diagram of the improved trigger switch.

DESCRIPTION OF THE INVENTION

Figure 1:
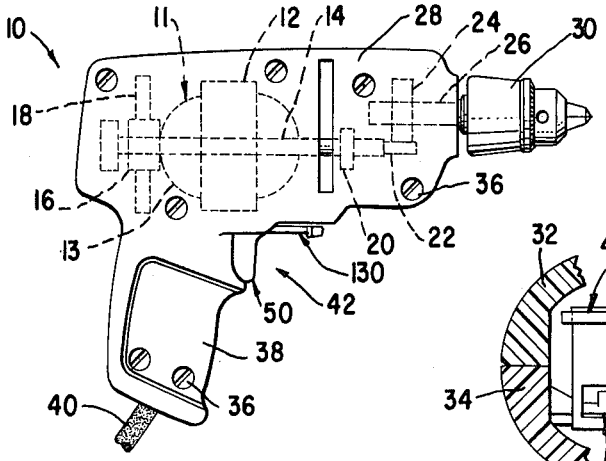
FIG. 1 is a side elevational view of a power tool, such as a drill, embodying the present invention.
Figure 4:
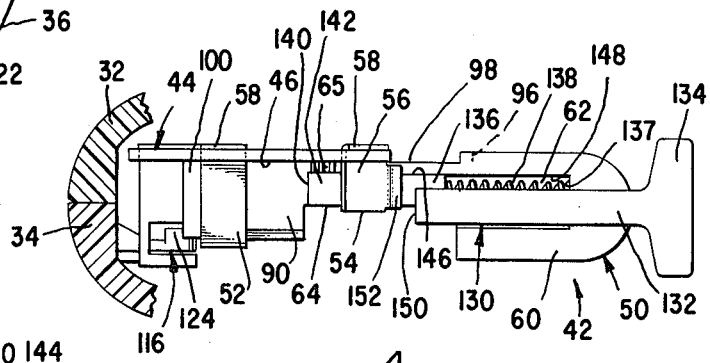
FIG. 4 is a top plan view taken along lines 4—4 of FIG. 2.

A power tool, such as a portable power drill 10 is shown in FIG. 1 embodying the present invention. The drill 10 includes an electric motor 11 having a field core 12 disposed about an armature 13 affixed to an armature shaft 14 which carries a commutator 16 engaged by a brush assembly 18. The armature shaft 14 is journaled in a pair of spaced bearings 20, and has a drive pinion 22 formed at its forward end. The pinion drives a gear train 24 and a driven spindle 26, the front of which exits the drill housing 28 to be threadedly connected to a chuck 30 which is adapted to drive a suitable bit or implement (not shown) that comes into engagement with the work. The motor 12 is journaled in the housing 28 as shown in FIG. 1 which is preferably of a clam shell construction as indicated in FIGS. 4 and 5 wherein a support portion 32 and a cover portion 34 are suitably connected to each other as by screw means 36 illustrated in FIG. 1 extending through the cover portion 34 of the housing 28 to be threadedly connected to the support portion or separate nut means (not shown) to form what is commonly termed a clam shell housing. The housing 28 has an integrally formed pistol grip handle 38 which receives an electric cord 40 depicted in FIGS. 1 and 9 that in turn is connected through a trigger switch 42 which is in circuit with the motor 12 as will be described more fully hereinafter under the schematic circuit diagram of FIG. 7.

In assembling the drill 10, the cover portion 34 will be removed from the support portion 32 of the housing 28 to permit easy access and visibility of all the drill components particularly those included in the trigger switch 42.

Figure 2:
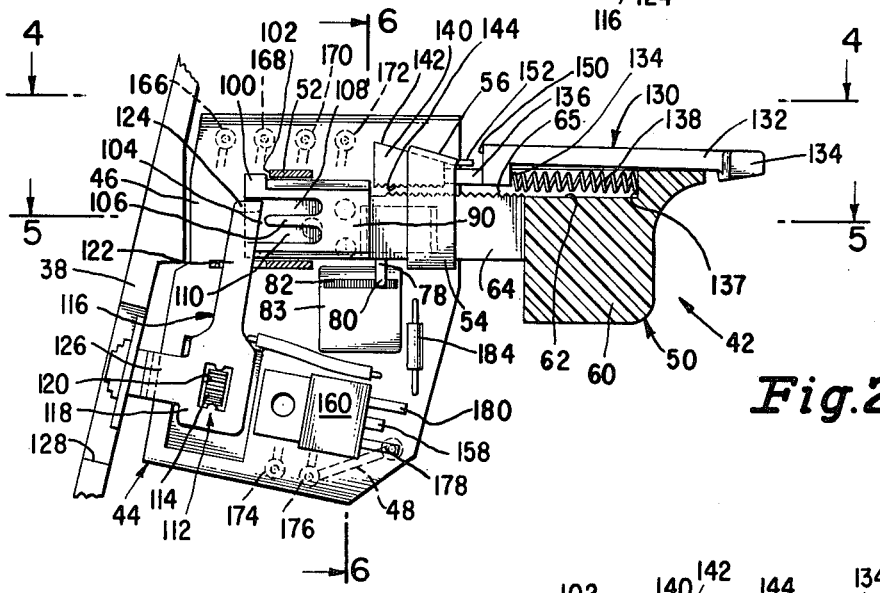
FIG. 2 is a side elevational view, partly in section, of the trigger switch of the present invention mounted in the handle, with only the rear portion thereof shown, with the switch in the "off" position, the locking member disengaged and the reversing switch interlocked in the forward position.

The improved trigger switch 42 has a printed circuit (PC) board 44 illustrated in FIG. 2, the face side 46 of which carries the discrete devices which are suitably electrically connected through the PC board 44 to the opposite side of the PC board 44, and in circuit with various PC conductor paths 48 some of which are shown by the dotted line representation. The PC board 44 is disposed to be connected in the handle 38 either by being entrapped between the handle halves 32 and 34 or by means of suitable bent tabs, screw fasteners or the like.

A trigger 50 is slidably affixed to the PC board 44 by a rear mounting strap or bracket 52 and a front mounting strap or camming bracket 54, the top 56 of which is tapered to extend forwardly and downwardly for purposes which will be explained more fully hereinafter. Each of the brackets 52 and 54 are connected to the PC board 44 by staking as illustrated in FIGS. 4 and 6 at stake points 58, 58.

Figure 3:
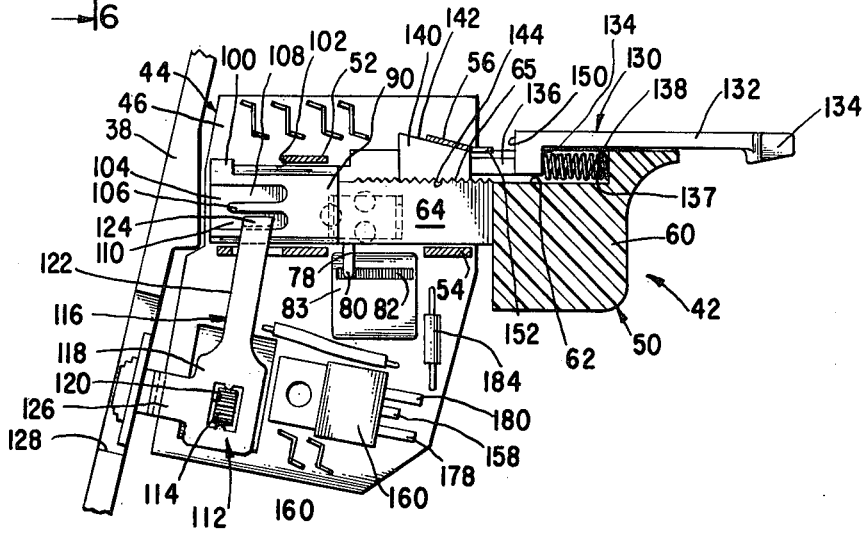
FIG. 3 is a side elevational view, partly in section, showing the trigger switch of FIG. 2 in the "on" position, the locking member engaged and the reversing switch interlocked in the reverse position.

The trigger 50 has a front portion 60 which projects from an opening in the handle as shown in FIG. 1 and is gently curved for comfortable engagement by the operator's finger. The trigger 50 will be longitudinally depressed into the handle 38 by the operator. A recess 62, shown in FIGS. 2, 3 and 4, is formed in the top of the forward portion 60 the base of which extends into the mid-portion 64 and serves as the top surface 65 thereof. The top 65 is serrated substantially along its entire length to form a high friction contact surface. A cavity 66 is formed in the mid-portion 64 on the side adjacent the PC board 44 to receive a substantially "U"-shaped switch contact wiper 68 shown in FIGS. 2, 5 and 6 as having a substantially flat base 70 which is loaded to the PC board 44 by two springs 72 and 74 disposed on round bosses 76, 76 formed in the side wall of cavity 66. The side turned legs of the wiper 68 serve to entrap the wiper 68 within the cavity 66. A resistance wiper 78 is disposed on the left most boss 76 shown in FIG. 5 and held in position by the spring 72 as illustrated in FIGS. 5 and 6. A contact finger 80 is formed integrally with the wiper 78 and extends downwardly from the open bottom of the cavity 66 to slidably engage a resistance strip 82 of a resistance-capacitance (RC) module 83 as shown in FIGS. 2, 3 and 6. Contact rivets 84, 86 and 88 are connected to the PC board 44 in the path of travel of the contact wiper 68 and positioned so that upon trigger 50 depression into the handle 38, the wiper 68 will first engage the contacts 84 and 86 and after predetermined further depression of the trigger contact will be made with the rivet contact 88 for purposes more fully explained hereinafter. A rear portion 90 of the trigger 50 extends from the mid-portion 64. The side face of the rear portion 90 facing the PC board 44 has a shallow recess 92, best seen in FIG. 5, which communicates with the cavity 66 and is sized to permit that portion of the trigger 50 to travel past, without interfering with, the contact rivets 84, 86 and 88. This is possible because a boss 94 is formed at the rearward end of the recess 92 to slidingly engage the face 46 of the PC board 44 to the left of the contact rivet 88. A stop 96 is formed on the inner side of the trigger 50 adjacent the junction point between the front and mid-portions 60 and 64, respectively, as depicted in FIGS. 4 and 5 to engage the forward edge 104 of the PC board 44 to limit the maximum depression of the trigger 50 within the handle 38. A side 98 illustrated in FIGS. 4 and 5 provides continuity for portions 60, 64 and 90 of the trigger 50, extends adjacent to the PC board 44 and contains the cavity 66 and recess 92 therein.

The trigger 50 has a different width for each portion, with the front portion 60 having the largest dimension and the mid-portion 64 having the smallest dimension. The brackets 52 and 54 are sized corresponding to the adjacent portion of the trigger 50 to be accommodated so that once assembled to the PC board 44 the trigger 50 will not be accidently dislodged. The rear portion 90 of the trigger 50 has a vertically extending projection 100 formed at its rear face side as shown in FIGS. 2, 3 and 4 which acts as a forward stop to engage the top rear edge 102 of the rear bracket 52 as shown in FIGS. 2 and 3 to prevent excessive forward motion of the trigger 50. An opening 104 shown in FIGS. 2, 3 and 5 is formed at the rear of the face side of the rear trigger portion 90 and leads into parallel horizontal slots, separated by a horizontal rib 106, with the upper slot 108 being designated for forward motor rotation, and the lower slot 110 being designated for reverse motor rotation, which slots are depicted in FIGS. 2 and 3.

A reversing switch 112 is affixed to the PC board 44 in circuit therein. The reversing switch 112 is a double pole-double throw (DPDT) type, and it has a slide button 114 used to position it in either forward or reverse. An actuator 116 having a body portion 118 with a central aperture 120 which is disposed about and in engagement with the slide button 114 of the reversing switch 112 so that movement of the actuator 116 will place the reversing switch in an upward position for forward motion of the motor 12 or in a downward position for reverse motion of the motor 12. An interlock arm 122 extends upwardly from the body 118 to terminate in an inwardly facing flange 124 shown in FIGS. 2, 3 and 4, which is sized to be slidingly disposed in the opening 104 to be shifted between slots 108 or 110 of the trigger 50. An actuator arm 126 extends rearwardly, as shown in FIGS. 2 and 3, from the body 118 to reside within an elongated slot 128 formed in the rear end of the handle 38 for sliding movement therein. The operator will position the actuator arm 126 in one of two positions, with the upper position shown in FIG. 2 for forward motion of the motor 12 whereby the flange 124 will be received in the forward slot 108 of the trigger 50, and the lower position shown in FIG. 3 for reverse motion of the motor 12 whereby the flange 124 was moved downwardly to be received in the reverse slot 110. The rib 106 acts to prevent operation of the reversing switch 112 during operation of the motor 12 upon depression of the trigger 50. Therefore, once the trigger 50 has been depressed, the flange 124 will engage the rib 106 to prevent the reversible operation of switch 118. Thus the actuator 116 can only change the position of the switch 112 when the flange 124 resides in the opening 104, corresponding to the trigger switch off position shown in FIG. 2.

A locking or lock-release member 130 is illustrated in FIGS. 2, 3 and 4 and has a forwardly extending external lever 132 which terminates in a "T"-shaped handle 134 which extends on either side of the trigger 50 as shown in FIG. 4. The lever 132 extends externally of the housing 38 immediately above and forwardly of the trigger 50 for convienent operator manipulation as more fully described hereinafter. The lever 132 is stepped down at its inner end to form an outwardly facing shoulder 134 adjacent an offset connection to a midsection 136 shown in FIGS. 2, 3 and 4. The end wall of the trigger recess 62 defines an inwardly facing shoulder 137. A spring 138 is disposed in the recess 62 and trapped between with its ends engaging the facing flanges 134 and 138 of the lock-release member 130 and the trigger 50, respective. The midsection 136 extends rearwardly to terminate in a cam shoe 140 the upper surface 142 of which is tapered corresponding to the tapered top 56 of the camming bracket 54. The lower surface 144 of the shoe 140 lies horizontally below the lower surface of the midsection 136 and is serrated to define a high friction contact surface. The cam shoe 140 of the locking member 130 is entrapped within the bracket 54, and the tapered surface 142 is in continual contact with the tapered top 56 of the bracket. With the cam shoe 140 in the rearmost position, the lower surface 144 will remain out of contact with the upper serrated surface 65 of the trigger 50. The midsection 136 of the locking member 130 being disposed in the recess 62 of the trigger 50 wherein the inner side 146 slidingly engages the side 148 of the recess 62 to guide the motion of the locking member 130 and limit it to the linear direction.

The spring 138 normally urges the trigger 50 forwardly and the lock-release member 130 rearwardly so that as viewed in FIG. 2, the trigger seeks to extend from the handle 38 but is prevented by stop 100, while the lock-release member 130 is urged into the handle 38 but is limited by a shoulder 150 abutting a bracket stop 152. Accordingly, the spring 138 will load the trigger 50 in the "off" position and the lock-release member 130 in the released position out of engagement with the trigger 50.

When the trigger 50 is in the unlocked position shown in FIG. 2, it can be moved freely through its entire depressed movement wherein it will start to compress the load spring 138 causing the lock-release member 130 to abut the bracket stop 152. Completely pulling the trigger 50 into the handle 38 will not completely compress the spring 138 as illustrated in FIG. 3 so as to permit free outward locking motion of the lock-release member 130. With simple trigger 50 pull in motion, upon release the spring 138 will force the trigger 50 to return to its normally "off" position. Though the present invention is useable with a simple "on-off" switch, it has been embodied in the trigger-switch 42 which includes speed control capabilities so as to more completely describe the advantageous results of the present invention. The extend of trigger 50 depression will determine the speed at which the drill motor 12 operates with the speed increasing as the trigger depression increases with the maximum depression of the trigger 50 being shown in FIG. 3.

To lock the trigger 50 at any desired speed setting of the trigger-switch 42, the trigger 50 will be retracted to obtain the desired speed, which in the present instance is assumed to be the maximum speed corresponding to the setting illustrated in FIG. 3, and will be held in that position while the lock-release member 130 is pushed forwardly. Forward movement of the lock-release member 130 causes the tapered surface 142 of the cam shoe 140 to slide forwardly and downwardly under the urging of the tapered top 56 of the camming bracket 54 until the cam shoe 140 becomes wedged-locked under the angled tapered top 56 of the camming bracket 54, thus forcing the lower surface 144 to seat its serrations into those formed on the top surface 65 of the trigger 50.

The force exerted by the wedge-lock of the cam shoe 140 of the lock-release member 130 is sufficient to overcome any restoring force which the spring 138 may exert upon the lock-release member 130. In this instance, the spring 138 forces are substantially balanced in that the force acting upon the trigger 50 seeks to maintain the wedge-lock while the force acting upon the lock-release member 130 seeks to release the member 130. In any event sufficient force is exerted on or by the cam shoe 140 of the lock-release member 130 to keep the contact surfaces 65 and 144, respectively, engaged with each other, and the cam shoe 140 wedged under the camming bracket 54 to prevent any further forward movement of the trigger 50, and therefore, any change of speed from the maximum illustrated in FIG. 3.

To release the lock-release member 130, the trigger 50 is pulled rearwardly to physically shift the cam shoe 140 rearwardly out from under the angled face or tapered surface 56 of the camming bracket 54 so as to initiate a disengagement of the serrated surfaces 65 and 144 whereby the spring 138 will simultaneously (1) push the lock-release member 130 rearwardly to cause the tapered surface 142 to ride upwardly along the tapered top 56 and away from the serrated top surface 65, and (2) urge the trigger 50 outwardly to the fully extended "off" position shown in FIG. 2. Once the trigger 50 is free from the wedge-lock and the separation of the serrated surfaces 65 and 144 is accomplished, the trigger 50 is released and the spring 138 will restore it to the "off" position. The length of the serrated top surface 65 of the trigger 50 is substantially twice the length of the lower serrated surface 146 of the cam shoe 142. This permits the trigger 50 to be locked in any desired speed setting from "off" to the maximum speed in the "on" setting.

The switch contact wiper 68 illustrated in FIGS. 2, 5 and 6 is loaded to the PC board 44 by the contact springs 72 and 74. The wiper 68 is entrapped in the trigger cavity 66 and will slide with the trigger 50. As the trigger 50 is pulled rearwardly, the wiper 68 first bridges the rivet contacts 84 and 86 shown in FIGS. 2 and 6, and in the schematic circuit diagram of FIG. 7. The various printed circuit conductor paths are designated generally 48, and are formed on the underside of the PC board 44 as illustrated in FIG. 2, and these conductor paths are shown in circuit in the schematic of FIG. 7 in which the lines or conductor paths will still be referred to by the general designation 48, but the electrical devices or components interconnected by the lines 48 will be specifically identified. Also, for a better understanding of the explanation of the electrical operation of the improved trigger switch 42 reference may be had to FIGS. 2 and 7.

Contact 86 is connected to the resistance-capacitance (RC) module 83 and the anode 158 of the silicon control rectifier (SCR) 160 via one of the PC conductor paths 48. Likewise contact 84 is connected to the reversing switch 112, the motor 12 to be controlled, as indicated by the armature 13 and the field 164 disposed within the dotted lines for the motor 12 of FIG. 7, and one side of the line voltage cord 40 via a PC conductor path 48 and a jumper wire or path also formed on PC board 44, and quick disconnect terminals 166, 168, 170, 172, 174 and 176. Terminals 166, 168, 170 and 172 serve as output terminals, while terminals 174 and 176 serve as line cord terminals. Contact 84 connects to the line voltage terminal 174, while the cathode 178 of the SCR 160 is connected to the other line voltage terminal 176, and therefore, bridging the contacts 84 and 86 will start the motor 12.

With the SCR 160 in series with the motor 12, the speed can be varied by the point into every other half cycle of line voltage (when the SCR 160 anode to cathode voltage is positive) at which SCR 160 is triggered into conduction via the gate 180 of the SCR 160. The gate 180 trigger point is determined by the position of the resistance wiper 78 on the primary resistance strip 82 of the RC module 83. The wiper 78 is carried on the boss 76 of trigger 50 and is connected to line voltage through the spring 72 and wiper 68 to the contact 84. As the trigger 50 moves rearwardly, the wiper 78 decreases the effective resistance on the module 83 and causes the capacitor 182 of the module 83 to charge faster. A trigger diode (diac) 184 breaks down sooner dumping the capacitor 182 charge into the gate 180 of the SCR 160 and therefore turns the SCR 160 on sooner. When the SCR 160 turns on sooner in each half cycle, the effective voltage of the motor 12 is higher and, therefore the motor 12 speed is correspondingly higher. As the trigger 50 moves rearwardly toward the end of its stroke, wiper 68 connects rivet contact 88 via a PC path 48 to the terminal 176 which shunts, or bypasses, the anode 158 and cathode 178 of the SCR 160. This connects the motor 12 to full A.C. line voltage and places the motor 12 into high speed operation. Of course, as the trigger 50 is released from the full "on" position, the above described operations are reversed in order of occurrence and the motor 12 speed decreases to zero at the full "off" position.

The reversing switch 112 is a DPDT PC switch which, when actuated, reverses the armature 13 terminals of the motor 12 relative to the field 164 which always remains connected in the same direction relative to the line voltage terminals 174 and 176. The armature 13 is connected to the common center terminals 166 and 170 and suitable PC conductor paths 48. A crossing pattern consisting of a PC conductor path 48 and a jumper wire or path (48) located on the underside of the body of the switch 112 connects the outside switching terminals of the switch and allows reversing to take place. It should be noted that the connected positions of the armature 13 and the field 164 can be interchanged, reversed the field relative to the armature with no change in performance and achieving proper motor reversal.

The RC module 83 contains a secondary resistor 186 in series with the main variable resistor 82. By trimming the secondary resistance 186, the initial speed of the motor, when it is first turned on, can be adjusted for the desired slow or "creep speed". Trimming can be accomplished with a laser or other suitable means of increasing the resistance by removing material from the secondary resistor 186.

The use of a single spring 138 for double duty of both trigger and lock-release action simplifies the components and assembly procedures. The spring 138 is conveniently nested in the recess 62 intermediate the trigger 50 and lock-release member 130. Thus spring hang-up is minimized and quick, positive spring response is assured for both trigger release and lock-release member release.

It will be understood that various changes in the details, materials, arrangements of parts and operating conditions which have been herein described and illustrated in order to explain the nature of the invention may be made by those skilled in the art within the principles and scope of the invention.

Having thus set forth the nature of the invention what is claimed herein is:

1. A quick lock-release mechanism for a trigger of a trigger-switch mounted in the handle of a drill housing for activating a motor of a drill, said mechanism selectively to lock or release the trigger comprising:

(a) the trigger slidably connected in the handle,
(b) a tapered member affixed in the handle,
(c) a locking member slidably connected to the tapered member and in superposition to the trigger,
(d) a spring disposed between the trigger and the locking member normally to urge each in opposite direction, and
(e) the locking member movable outwardly to be forced by the tapered member into a wedge-lock position against the trigger whereby the trigger-switch is locked "on" and releasable upon slight trigger depression.

2. The combination claimed in claim 1 wherein:

(a) the locking member has an extended locked position and a retracted released position.
(b) the trigger has an extended "off" position and a variable depressed "on" position,
(c) the locking member having a lever extending outwardly of the handle, a tapered shoe slidably engaging the tapered member, and a shoulder formed intermediate the tapered shoe and the lever,
(d) a shoulder formed on the trigger facing the shoulder on the locking member,
(e) a cavity formed in the trigger including the trigger shoulder,
(f) the spring is nested in the cavity, and
(g) the shoulder of the locking member extends into the cavity.

3. The combination claimed in claim 2 in which the trigger switch is included in a motor speed control circuit in which the increased depression of the trigger will cause increased speed of the motor wherein:

(a) the locking member in unlocked position movable independently of the trigger, and in locked position being releaseable upon trigger depression, and
(b) the locking member being shifted into the locked position to prevent automatic release of the trigger upon the trigger being depressed to attain a predetermined motor speed.

4. The combination claimed in claim 3 wherein:

(a) the locking member disposed in the handle above the trigger to move substantially in straight line motion parallel to the trigger,
(b) a friction surface formed on the underside of the tapered shoe,
(c) a friction surface formed on the upperside of the trigger adjacent to the friction surface of the locking member whereby on forward motion of the locking member the respective friction surfaces to be wedged-locked together.

5. The combination in claim 4 wherein:

(a) the friction surface of the trigger of substantial greater length than the friction surface of the locking member.

* * * * *